US009604835B2

(12) United States Patent
Peirsman et al.

(10) Patent No.: US 9,604,835 B2
(45) Date of Patent: Mar. 28, 2017

(54) LIQUID DISPENSING APPLIANCE COMPRISING A SOLID GAS-ADSORBENT

(75) Inventors: Daniel Peirsman, Brussels (BE); Stijn Vandekerckhove, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 162 days.

(21) Appl. No.: 14/112,910

(22) PCT Filed: Apr. 17, 2012

(86) PCT No.: PCT/EP2012/057005

§ 371 (c)(1),
(2), (4) Date: Oct. 18, 2013

(87) PCT Pub. No.: WO2012/143352

PCT Pub. Date: Oct. 26, 2012

(65) Prior Publication Data

US 2014/0034667 A1 Feb. 6, 2014

(30) Foreign Application Priority Data

Apr. 18, 2011 (EP) ..... 11162787

(51) Int. Cl.

| | |
|---|---|
| ***B65D 35/28*** | (2006.01) |
| ***B67D 1/00*** | (2006.01) |
| ***B67D 1/04*** | (2006.01) |

(52) U.S. Cl.

CPC ..... *B67D 1/0001* (2013.01); *B67D 1/0406* (2013.01); *B67D 1/0443* (2013.01); *B67D 2001/0493* (2013.01)

(58) Field of Classification Search

CPC ..... B67D 1/0467; B67D 2001/0493; B67D 1/0462; B67D 1/0406; B67D 1/0443

USPC ..... 222/95, 400.7

See application file for complete search history.

(56) References Cited

U.S. PATENT DOCUMENTS

| | | | | |
|---|---|---|---|---|
| 3,096,000 | A | 7/1963 | Staley | |
| 4,049,158 | A | 9/1977 | Lo et al. | |
| 6,770,118 | B2 | 8/2004 | Stolyarevsky | |
| 6,793,428 | B2 * | 9/2004 | Lithgow | 401/48 |
| 6,824,017 | B2 | 11/2004 | Sluijter | |
| 7,237,696 | B2 * | 7/2007 | Magermans et al. | 222/400.7 |
| 7,810,679 | B2 * | 10/2010 | Wauters | B67D 1/0462 222/105 |

(Continued)

FOREIGN PATENT DOCUMENTS

| | | |
|---|---|---|
| EP | 0 149 352 | 7/1985 |
| EP | 2 405 164 | 1/2012 |

(Continued)

*Primary Examiner* — Patrick M Buechner

(74) *Attorney, Agent, or Firm* — Levy & Grandinetti

(57) ABSTRACT

A kit of parts for dispensing a liquid contained in a container is disclosed. The kit includes a pressure driven dispensing appliance. The pressure driven dispensing appliance has a device for receiving a container containing a liquid to be dispensed. The appliance also has a device for dispensing the liquid from the container, when mounted in the appliance, a chamber containing a solid adsorbent suitable for adsorbing air, and a device for fluidly connecting the chamber with the interior of the container, when mounted in the appliance. An air compressor releasibly connectable to the chamber is also included.

22 Claims, 2 Drawing Sheets

(56) References Cited

U.S. PATENT DOCUMENTS

| | | | | |
|---|---|---|---|---|
| 2004/0011199 | A1* | 1/2004 | Cogotzi | B01D 53/053<br>95/138 |
| 2006/0278078 | A1* | 12/2006 | Holt | B01D 53/047<br>95/138 |
| 2009/0289085 | A1* | 11/2009 | Schiff | B65D 83/663<br>222/396 |
| 2011/0121027 | A1* | 5/2011 | Kambouris | 222/94 |
| 2011/0226343 | A1* | 9/2011 | Novak | A23L 2/54<br>137/12.5 |
| 2014/0217126 | A1* | 8/2014 | Peirsman | B67D 1/0004<br>222/399 |
| 2016/0083239 | A1* | 3/2016 | Rasmussen | B67D 1/0443<br>222/1 |

FOREIGN PATENT DOCUMENTS

| | | |
|---|---|---|
| WO | WO 99/47451 | 9/1999 |
| WO | WO 2005/007559 | 1/2005 |
| WO | WO 2005/070788 | 8/2005 |
| WO | WO 2006/086932 | 8/2006 |
| WO | WO 2008/053215 | 5/2008 |
| WO | WO 2008/053216 | 5/2008 |
| WO | WO2008/129012 | 10/2008 |
| WO | WO 2008/129013 | 10/2008 |
| WO | WO 2008/129015 | 10/2008 |
| WO | WO 2008/129016 | 10/2008 |
| WO | WO 2008/129018 | 10/2008 |
| WO | WO 2009/090223 | 7/2009 |
| WO | WO 2009/090224 | 7/2009 |
| WO | WO 2009/090225 | 7/2009 |
| WO | WO 2009/142977 | 11/2009 |
| WO | WO 2010/031764 | 3/2010 |
| WO | WO 2011/009154 | 1/2011 |

* cited by examiner (a)

(b)

LIQUID DISPENSING APPLIANCE COMPRISING A SOLID GAS-ADSORBENT

This Application is the U.S. National Phase of International Application Number PCT/EP2012/057005 filed on Apr. 17, 2012, which claims priority to European Application Number 11162787.3 filed on Apr. 18, 2011.

TECHNICAL FIELD

The present invention relates to pressure driven liquid dispensing devices, in particular for dispensing beverages, such as soft drinks and beer. In particular, it concerns a dispensing device comprising a chamber containing an adsorbent for storing a high amount of gas under moderate pressure which is cheap to use for the end user. The dispensing appliance can be used without any electrical power, which is ideal for outdoor uses such as in picnics, but also for storing and using it safely in a traditional fridge.

BACKGROUND FOR THE INVENTION

Pressure driven dispensing appliances for dispensing a liquid, such as a beverage, typically beer, have long been known in the art. A pressurized gas, such as carbon dioxide, is injected into the container containing the liquid to be dispensed in order to increase the pressure in the vessel with respect to ambient. Dispensing of a liquid is then simply controlled by the actuation of a valve located on a dispensing duct to bring the liquid contained in the container in fluid communication with ambient. The pressurized gas is usually stored in a pressure vessel of varying sizes depending on the end application, keeping in mind that sufficient gas must be available to at least empty a full liquid container of its content. The gas content of a pressurized gas vessel depends on the capacity of the vessel, and on the pressure of the gas, which in turn depends on the wall thickness of the vessel. For high capacity kegs of 10 liters and more as are used in pubs, a large, separate pressurized gas bottle is used and each time connected to a new keg. On the other hand, for home appliances of lower capacity of about 3 to 10 liters as are becoming more and more appreciated by the consumers, the pressure vessel is usually integrated within the appliance body. For containers of relatively small capacity, it is quite easy to fit a relatively small gas cartridge as disclosed e.g., in EP149352, under sufficient pressure (e.g., a typical $CO_2$ cartridge is loaded at a pressure of the order of 100 bar) to deliver sufficient overpressure to the container for the dispensing of the whole content thereof. Problems start to arise, when more gas is required for driving the dispensing of larger volumes of liquid out of a container, as larger pressure vessels are required either to increase the vessel's capacity, or to strengthen the walls to withstand higher pressures. Both options are detrimental to the cost and aesthetic of the appliance. It should be noted that, for a same pressure resistance, the wall thickness of a pressure vessel increases non linearly with the capacity of the vessel.

In order to reduce the size of the gas storing vessel for a given amount of gas, it has been proposed to adsorb gas, usually carbon dioxide, on a solid substrate such as activated carbon, silica gel, zeolite, and the like. WO99/47451 discloses a device for storing and dispensing carbonated beverages such as beer comprising a compartment containing an amount of activated carbon fibres having a relatively large internal and external surface area, for adsorbing and/or absorbing therein and thereon a relatively large amount of $CO_2$ at an acceptable gas pressure. Similarly, U.S. Pat. No. 4,049,158, WO2009/142977, U.S. Pat. No. 3,096,000, and WO2006/086932, disclose dispensing appliances storing propellent gases on various types of adsorbents. All the foregoing appliances have a drawback in common with most small size pressurized gas vessels, in that they are disposable and must be replaced with each new container, which increases substantially the cost of use of such appliances by the end-consumer US2003136261 suggests to re-fill the gas storage compartment with a tablet, pellet or a ball of condensed firm phase $CO_2$ (so-called-"dry ice"), which is not quite suitable for home applications. WO2005/070788A and WO2008/053215 disclose the use of a one-way valve to allow the introduction of carbon dioxide in to the solid/gas compartment prior to use, and during use of the system. This requires a source of pressurized $CO_2$, which is normally available to the public only in pressurized bottles, which need be bought, stored, and refilled at specific places.

The present invention proposes a solution for a liquid dispensing appliance requiring very little budget for the use thereof, other than the purchase of a new liquid container, which can dispense a liquid without need of any external electric power energy, so that it can be used outdoor, or stored in a fridge, without risk of short circuits due to condensation or a battery leaking onto food. These and other advantages of the present invention are described in the following sections.

SUMMARY OF THE INVENTION

The present invention is defined in the appended independent claims. Preferred embodiments are defined in the dependent claims. In particular, the present invention concerns a kit of parts comprising:

(a) A pressure driven dispensing appliance comprising:
- Means for receiving a container containing a liquid to be dispensed:
- Means for dispensing the liquid out of said container when mounted in the appliance;
- A chamber containing a solid adsorbent suitable for adsorbing air;
- Means for fluidly connecting said chamber with the interior of the container when mounted in the appliance; and (b) An air compressor releasibly connectable to said chamber.

The chamber may be detachable from the appliance so that air re-filling thereof can be carried out by simply detaching the chamber from the appliance and connecting it to an air compressor. The air compressor is preferably separate from the appliance, but for sake of compactness, it may be integrated in the appliance. Connection thereof to a source of electrical power, however, is required only upon re-filling of the chamber. In this case, the chamber needs not be detachable from the appliance. The solid adsorbent contained in the chamber should have a high affinity with nitrogen and/or oxygen, the two major components of air, forming about 99 wt. % of air. In particular, the adsorbent is preferably selected from the group of type 5A or type 13X or Li-containing zeolites, activated silica, activated carbon, and mixtures thereof. In a preferred embodiment, it comprises zeolite LiLSX zeolite.

In a preferred embodiment, the chamber (30) is detachably coupled to the appliance at a location close to the tapping valve, preferably to the appliance lid, so that if the appliance is stored in a fridge, the chamber can easily be removed from the appliance without moving the whole system. In another embodiment, the chamber (30) can be coupled directly to the corresponding air opening (15B) of the closure of the container. This embodiment could be cheaper, but has the inconvenience that each of the dispensing duct (10*a*) and air chamber (30) need be connected individually to the container.

A container can be mounted in the receiving means of the dispensing appliance such that it can be connected to the dispensing means and to the connection means to the chamber. In a preferred embodiment, the container is a bag-in-container or a bladder-in-container. The container preferably contains a beverage, preferably a carbonated beverage, more preferably a beer.

The means for dispensing the liquid out of said container and means for fluidly connecting said chamber with the interior of the container generally comprise corresponding tubes. In particular the dispensing tube is generally provided with a valve for controlling the flow of liquid therethrough. One connecting end of each tube is connectable to corresponding openings preferably provided on the closure of a container mounted in the dispensing appliance to bring them in fluid communication with the interior of said container. In particular, the connecting ends of each of the dispensing tube and gas tube may be mounted in a lid of the dispensing appliance. Upon closing the lid over the closure of a container mounted therein the tube ends are driven through the corresponding openings of the closure bringing the interior of said container in fluid communication with ambient and the chamber (30), respectively. The air tube too preferably comprises a valve between the two ends of the air tube (15A) thereof. Said valve is preferably a pinch valve comprising resilient means naturally biased for seal pinching a flexible portion of the air tube, and opening upon bringing the dispensing appliance into a dispensing position with a container mounted therein.

The kit of parts of the present invention permits to use the dispensing appliance for dispensing a liquid, preferably a beverage, without the need of any electrical power, be it in the form of batteries or a connection to an electrical net. The dispensing unit can therefore be used outdoor, or stored in a fridge. The present invention also concerns a dispensing appliance as defined supra.

The present invention also concerns a method for dispensing a liquid out of a container comprising the following steps:

(a) providing a liquid dispensing appliance as discussed supra;

(b) connecting an air compressor to the chamber containing solid adsorbent and injecting compressed air therein, until a desired amount of air is stored in the chamber, after which said air compressor is disconnected;

(c) Mounting a container into the receiving means of the dispensing appliance;

(d) Fluidly connecting the dispensing means with the liquid contained in the container;

(e) Fluidly connecting the chamber (30) with the interior of the container to increase the air pressure in said container to a desired level; and (f) Dispensing liquid out of the container through the dispensing means (10A) driven by the air pressure obtained in the previous step.

The injection of compressed air into the air chamber is preferably carried out with the latter being in fluid communication with the interior of the container.

The present invention provides a pressure dispensing appliance capable of dispensing a liquid contained in a container without any source of electrical power. Furthermore, pressurized gas can be stored in sufficient amount to drive the dispensing of the whole liquid content of a container under limited pressure by use of an adsorbent. One great advantage of the present invention is that the chamber storing the gas needs not be changed after use, but on the contrary can be refilled very easily before loading a new container. This solution reduces considerably the use cost by the end user who needs not buy a pressurized gas container or an adsorbent chamber after each use.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
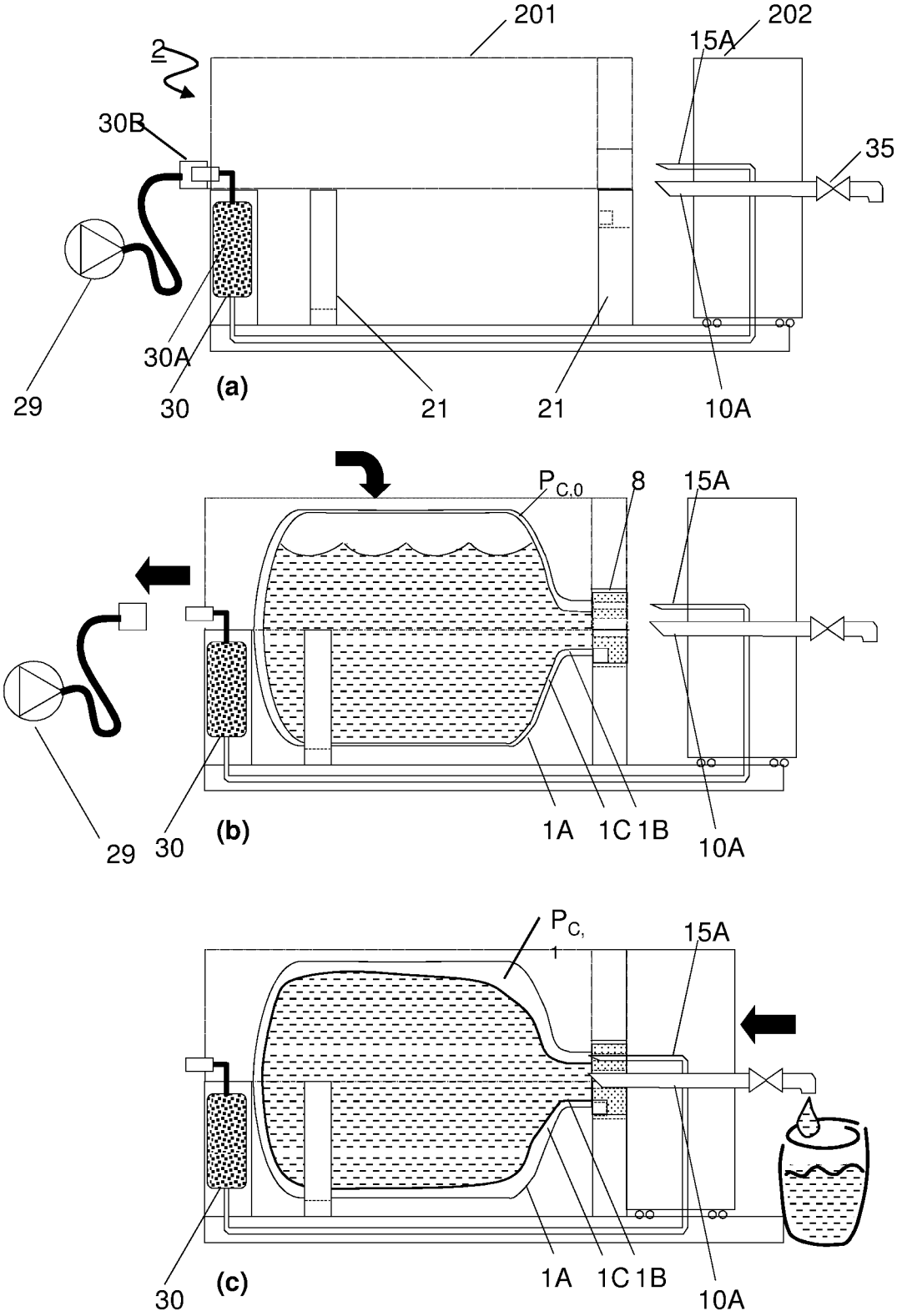
FIG. 1: shows a dispensing appliance and air compressor according to the present invention with a container mounted therein, with the different stages for the use thereof.

As illustrated in FIG. 1, a pressure dispensing appliance according to the present invention comprises means (21) for receiving a container (1) containing a liquid to be dispensed. Receiving means (21) can be of any form suitable for receiving a container. Generally the container (1) will comprise substantially cylindrical body and neck portions so that the receiving means (21) are illustrated in FIG. 1 as stands with a half cylindrical cut-off section for receiving a portion of the body and neck. Of course, other geometries are possible and the present invention is not restricted by the geometry of the receiving means (21). It should be noted that while the container illustrated in FIG. 1 lies horizontally, it could also be standing with the opening facing up. A dispensing appliance as illustrated in FIG. 1, wherein the container lies horizontally, is particularly suitable for being stored on a shelf of a conventional fridge.

Figure 2:
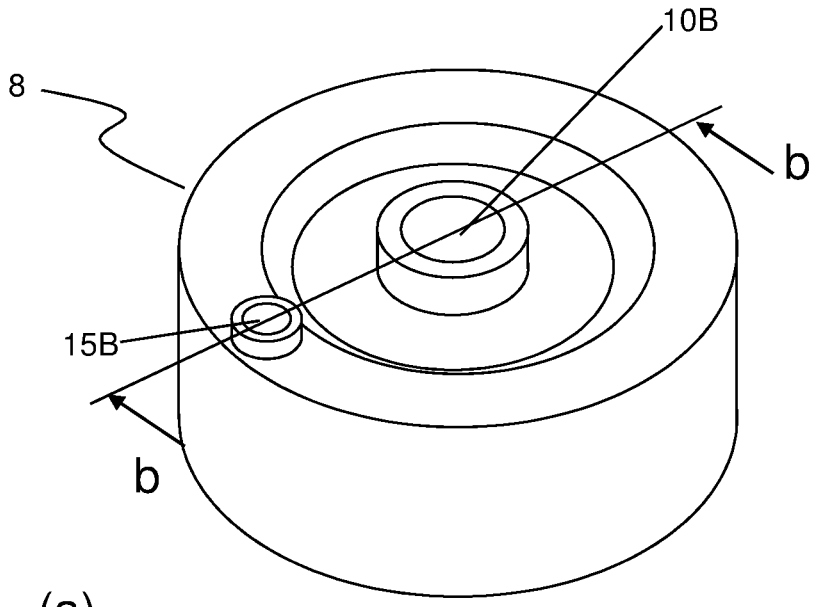
FIG. 2: shows a closure comprising first and second openings for receiving dispensing means and gas connection means of a dispensing appliance according to the present invention.
Figure 2:
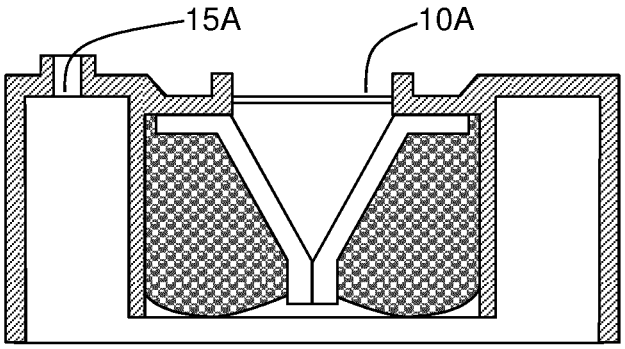

The dispensing appliance of the present invention also comprises means (10A) for dispensing the liquid out of said container (1) when mounted in the appliance. Generally speaking, the dispensing means (10A) comprise a tube suitable for bringing in fluid communication the liquid contained in the container (1) with ambient. In a preferred embodiment it comprises a valve allowing the opening, closing, and controlling of the flow of liquid through the tube. If the tube is flexible, the valve is advantageously a pinch valve, as pinch valves do not get in contact with the liquid to be dispensed. Other valves are of course possible, but pinch valves are preferred. The tube may be straight between its two ends as schematically illustrated in FIG. 1, but it preferably has curves and/or cross-section variations in order to decrease the pressure difference between liquid and ambient as the liquid approaches the outlet as disclosed e.g. in WO2005/007559. The inlet of the dispensing tube (10A) preferably comprises a hardened and/or sharp tip to allow the introduction thereof through a corresponding dispensing opening (10B) in the container. Preferably, the dispensing opening (10B) is located in the closure of the container as illustrated in FIGS. 1 and 2.

The dispensing appliance of the present invention also comprises an air chamber (30) containing a solid adsorbent (30A) capable of adsorbing and desorbing large quantities of air. Most gas/adsorbent systems used in conventional dispensing appliances are designed for adsorbing carbon dioxide as propellant. The present invention moves away from this trend, and aims at using air instead as propellant gas adsorbed in the chamber. Typical adsorbents particularly suitable for storing air are zeolites, in particular zeolites with a high affinity for nitrogen or oxygen, such as type 5A or type 13X or Li-containing zeolites, preferably, it comprises zeolite LiLSX, The adsorbent can be composed of a mixture of components, for example one of the foregoing zeolites admixed with activated silica, or activated carbon. The chamber may have rigid walls or, alternatively, flexible walls thus forming a pouch. It is preferred that the walls may resist high pressure differences between inside and outside the chamber (30) to increase the gas storage capacity of the chamber (30) at higher pressures. The pressure inside the chamber when it is saturated with air is preferably in the range of 2 and 10 bar with a corresponding increase of air content of at least two folds, preferably at least one order of magnitude higher than for a similar chamber absent the adsorbent (30A). It follows that a plastic chamber can be used instead of a metal high pressure container required for storing gas at a pressure of 100 bar.

The chamber (30) can be fluidly connected by means (15A) with the interior of a container (1) mounted in the dispensing appliance. Air connecting means (15A) comprise a tube running from the interior of the chamber to the interior of the container. The outlet of pressurized air tube (15A) can be in fluid communication with the liquid contained in the container (1) provided contact with air is not detrimental to the stability of the liquid. It is preferred, however, to use as container (1) a bag-in-container, or a bladder-in-container. The liquid to be dispensed in a bag-in-container is contained in a flexible bag (1B) contained in a rigid outer container (1A). Pressurized air is injected into the space (1C) comprised between the inner bag (1B) and outer container (1A), thus collapsing the bag and driving the flow of liquid contained therein out of the container (1). In a bladder-in-container, the liquid is contained in the space (1C) between a flexible inner bladder and an outer container, and pressurized air is injected into the bladder to blow it, so as to push the liquid out of the container. It is preferred in the present invention to use a bag-in-container as illustrated in FIG. 1 and disclosed in EP2146832, EP2148770, WO2010/031764, EP2152494, EP2152486, EP2148771, the teachings of which being incorporated herein by reference. Again, the outlet of the air connecting tube (15A) is preferably hardened and/or sharp to allow introduction thereof through a corresponding air inlet (15B) in the container, preferably located in the closure (8) as illustrated in FIGS. 1 and 2.

The gist of the present invention is to use air as a propellant, and to use an air compressor which can be connected to the air chamber to refill the latter whenever the pressure in the container is too low. The chamber may be detachable from the appliance so that air re-filling thereof can be carried out by simply detaching the chamber from the appliance and connecting it to an air compressor without moving the whole appliance from, e.g., a fridge, where it is stored. In another embodiment, the air compressor may be integrated in the appliance. When re-filling the chamber (30) with air is required, the appliance may be connected to a source of electrical power, to activate the air compressor. When this operation is completed, the compressor in the appliance can be unplugged from the electric source and used again.

It is not necessary with a dispensing appliance according to the present invention to buy an expensive new gas pressure cartridge or adsorbent chamber after each container has been emptied, nor to store a large pressurized $CO_2$ bottle to be refilled regularly at specific places. All that is required here is to purchase a dispensing appliance and an air compressor, readily available at very low cost and taking little room, and every time a container is being emptied, it suffices to connect the air compressor to the appliance, and after a couple of minutes, the air chamber (30) is refilled and ready for the dispensing of a new container (1).

As illustrated in FIGS. 1 and 2, in a preferred embodiment the container (1) to be mounted in the dispensing appliance comprises an air opening (15B) for receiving the outlet of the air tube (15A) connected to the air chamber (30) and a dispensing opening (10B) for dispensing the liquid out of the container, both openings being located in the closure (8). In a preferred embodiment, the inlet of dispensing tube (10A) and the outlet of the air tube (15A) are mounted in the lid of the dispensing appliance, the closing of which upon the closure (8) of a container mounted therein driving them through the corresponding openings (10B, 15B) of the closure bringing the interior of said container in fluid communication with ambient and the chamber (30), respectively. The lid may move linearly from an open position (cf. FIG. 1(*b*)) into its dispensing position (cf. FIG. 1(*c*)), or can be mounted on hinges to rotate from an open position to a dispensing position. The closing of the lid drives the ends of the two dispensing and air tubes (10A, 15A) into the corresponding dispensing and air opening (10B, 15B) provided in the closure (8) as illustrated in FIGS. 1(*c*) and 2.

Closure (8) can be as depicted in FIG. 2, comprising a first dispensing opening (10B) and a second air opening (15A), separated from the former. For bag-in-containers, the two openings must be compartmented as illustrated in the cross section of FIG. 2(*b*) with the dispensing opening (10B) opening into the inner bag (1B) containing the liquid and the air opening (15B) in the inter-layer space (1C) comprised between inner bag and outer container. Examples of closures suitable for the present invention are disclosed e.g., in EP10168970, EP09701637, EP09702646, EP09703041, the contents of which are incorporated herein by reference.

As the air tube (15A) is introduced into the container (1)—preferably in the space (1C) between inner and outer containers (1A, 1B) of a bag-in-container—a valve (not shown) can be opened to bring the air chamber (30) in fluid communication with the interior of the container. The pressure drop thus created drives desorption of air from the adsorbent and the pressure in the container increases accordingly. In case of a bag-in-container, as illustrated in FIG. 1(*c*) the increased pressure in the space (1C) between the inner and outer layers (1A, 1B) squeezes the inner bag (1B) reducing the head space therein (compressing air or any gas contained in the head space) and pressurizing the liquid. As the valve (35) on the dispensing tube (10A) is opened, liquid will flow out through the dispensing tube (10A) increasing the volume of the inter-layer space (1C), and thus reducing the pressure in the air chamber (30). This pressure drop in turn drives the desorption of additional air from the adsorbent (30A) stored in the air chamber (30) and rises the pressure in the container back to a desired value. Such system is particularly suitable for dispensing beverages, in particular carbonated beverages, more particularly beers. The use of a bag-in-container is much preferred as it shields the liquid contained in the inner bag (1B) from any contact with the pressurized air contained in the inter-layer space (1C). For liquids which are not sensitive to air oxidation, however, a normal container can be used. The principle of pressure regulated adsorption/desorption of a gas on and off a solid adsorbent is well known in the art and reference is made to the prior art cited in the Background Art, and to general textbooks for additional information on the topic.

It has been shown that the present invention is highly advantageous over prior art dispensing appliances as it did not require the replacement of the gas storage unit after use, be it a pressurized cartridge, or a chamber comprising gas adsorbed on a solid adsorbent. The present invention is also advantageous in that it does not require the use of any external electrical power for its use. Indeed, some appliances do not comprise a pressure storage container, but are linked directly to a pump, such as e.g., in US2006/0138177. The pump, however, requires power to pressurize the interior of a container to drive the flow of liquid out thereof. It can therefore not be used outdoor, unless batteries are used, and it cannot be stored in a fridge, lest the condensation would damage the electrical circuit, or batteries may leak onto the food stored in the fridge. The present dispensing appliance, allows to re-use the air chamber (30) as often as desired, by refilling it with compressed air using a low-cost air compressor every time the amount of air in the chamber (30) becomes too low. This operation takes only a couple of minutes. The air compressor can then be disconnected, and no power is required for dispensing the liquid until a next air refill of the chamber (30) becomes necessary.

A dispensing appliance according to the present invention therefore requires connecting means (30B) for connecting in fluid communication an air compressor with the interior of the chamber (30). Any type of connection can be used, provided it is reversible in that it can be connected and disconnected easily. A snap fit connection is suitable, as well as bayonet and screw types connections, and the like.

A dispensing appliance and air compressor according to the present invention can be used as follows for dispensing a liquid contained in a container (1).

connecting the air compressor (29) to the chamber (30) containing solid adsorbent (30A) and injecting compressed air therein, until a desired amount of air is stored in the chamber, after which said air compressor is disconnected;

Mounting a container (1) into the receiving means (21) of the dispensing appliance (2);

Fluidly connecting the dispensing means (10A) with the liquid contained in the container (1);

Fluidly connecting the chamber (30) with the interior of the container (1). If the air connecting tube (15A) is closed by a valve, opening the valve to increase the air pressure in the container to a desired level. If the container is a bag-in-container, the air connecting tube (15A) shall be brought into fluid communication with the inter-layer space (1C) comprised between the inner and outer layers (1A, 1B) of the container (1). If a bladder in container is used, the air tube (15A) shall be connected to the interior of the bladder.

Dispensing liquid out of the container (1) through the dispensing means (10A) driven by the air pressure obtained in the previous step.

In order to increase the amount of air introduced into the container by the air compressor (29) it is possible to pump air into the air chamber (30) while it is in fluid communication with the interior of a container (1) in order to already increase the pressure therein prior to the first use of the dispenser; the first dispensing can therefore be driven by the air pressure in the container prior to any desorbing of air from the adsorbent.

For safety and comfort of use, the air tube (15A) may comprise at least a flexible portion, provided with a pinch valve that squeezes in a closed position the tube when the lid is an open position (as in FIG. 1(*b*), the pinch valve is not shown), and the pinch valve releases the pressure on the tube to open it when the lid is in dispensing position.

The invention claimed is:

1. A pressure driven dispensing appliance comprising:

a device for receiving a container containing a liquid to be dispensed;

a device for dispensing the liquid from the container, when mounted in the appliance;

a chamber containing a solid adsorbent suitable for adsorbing air;

a device for fluidly connecting the chamber with an interior of the container when mounted in the appliance;

wherein, the appliance further comprises a connecting device for connecting in fluid communication an air compressor with the interior of the chamber.

2. A method for dispensing a liquid from a container comprising the following steps:

providing a liquid dispensing appliance, the liquid dispensing appliance comprising:

(a) a pressure driven dispensing appliance comprising:

a device for receiving the container containing the liquid to be dispensed;

a device for dispensing the liquid from the container when mounted in the appliance;

a chamber containing a solid adsorbent suitable for adsorbing air; and a device for fluidly connecting the chamber with an interior of the container, when mounted in the appliance; and (b) an air compressor connectable to the chamber;

connecting the air compressor to the chamber containing solid adsorbent and injecting compressed air therein, until a desired amount of air is stored in the chamber, after which the air compressor is disconnected;

mounting the container into a device for receiving the container of the dispensing appliance;

fluidly connecting the device for dispensing the liquid contained in the container;

fluidly connecting the chamber with the interior of the container to increase the air pressure in the container to a desired level; and dispensing liquid from the container through the dispensing device driven by the air pressure obtained in the previous step.

3. The method according to claim 2, wherein compressed air is injected into the air chamber when the latter is in fluid communication with the interior of the container.

4. The method according to claim 2, wherein the pressure dispensing appliance further comprises:

the chamber being detachable from the appliance;

the solid adsorbent having a high affinity for nitrogen and/or oxygen;

the container being mounted in the device for receiving the container of the dispensing appliance, the container being suitable for being connected to the device for dispensing and to the device for fluidly connecting to the chamber; and the container being a bag-in-container or a bladder-in-container.

5. The method according to claim 4, wherein the pressure dispensing appliance further comprises:

the device for dispensing the liquid from the container and device for fluidly connecting the chamber with the interior of the container comprising corresponding tubes, one connecting end of each tube being connectable to corresponding openings provided on a closure of the container mounted in the dispensing appliance to bring them in fluid communication with the interior of the container;

the connecting ends of each of the dispensing tube and a gas tube being mounted in a lid of the dispensing appliance, the closing of which, upon the closure of the container mounted therein, drives them through the corresponding openings of the closure bringing the interior of the container in fluid communication with ambient and the chamber, respectively;

a valve being provided between the two ends of the dispensing tube;

a valve being provided between the two ends of the gas tube; and when sufficient gas is adsorbed on the adsorbent contained in the chamber, the dispensing appliance is suitable for dispensing a beverage contained in the container mounted therein without the supply of any electrical energy and, in particular, requiring no battery or connection to an electrical net.

6. A kit of parts for dispensing a liquid contained in a container, comprising:

(a) a pressure driven dispensing appliance comprising:

a device for receiving the container containing the liquid to be dispensed;

a device for dispensing the liquid from the container, when mounted in the appliance;

a chamber containing a solid adsorbent suitable for adsorbing air; and a device for fluidly connecting the chamber with an interior of the container, when mounted in the appliance; and (b) an air compressor connectable to the chamber.

7. The kit of parts according to claim 6, wherein, when sufficient gas is adsorbed on the adsorbent contained in the chamber, the dispensing appliance is suitable for dispensing a beverage contained in the container mounted therein without the supply of any electrical energy and, in particular, requiring no battery or connection to an electrical net.

8. The kit of parts according to claim 6, wherein the device for dispensing the liquid out of said container and the device for fluidly connecting said chamber with the interior of the container comprise corresponding tubes, one connecting end of each tube being connectable to corresponding openings provided on the closure of a container mounted in the dispensing appliance to bring them in fluid communication with the interior of said container.

9. The kit of parts according to claim 6, wherein the solid adsorbent has a high affinity for nitrogen and/or oxygen.

10. The kit of parts according to claim 9, wherein the solid adsorbent is selected from the group consisting of activated silica, activated carbon, and zeolites with a high affinity for nitrogen and/or oxygen LiX, LiLSX and other Li-containing zeolites, and mixtures thereof.

11. The kit of parts according to claim 6, wherein a container is mounted in the receiving means of the dispensing appliance, said container being suitable for being connected to the dispensing means and to the connection means to the chamber.

12. The kit of parts according to claim 11, wherein the container is a bag-in-container or a bladder-in-container.

13. The kit of parts according to claim 6, wherein the chamber is detachable from the appliance.

14. The kit of parts according to claim 13, wherein the solid adsorbent has a high affinity for nitrogen and/or oxygen.

15. The kit of parts according to claim 14, wherein the container is mounted in the device for receiving the container of the dispensing appliance, the container being suitable for being connected to the device for dispensing and to the device for fluidly connecting to the chamber.

16. The kit of parts according to claim 15, wherein the container is a bag-in-container or a bladder-in-container.

17. The kit of parts according to claim 16, wherein the container contains a beer.

18. The kit of parts according to claim 16, wherein the container contains a beverage.

19. The kit of parts according to claim 18, wherein the device for dispensing the liquid from said container and device for fluidly connecting the chamber with the interior of the container comprise corresponding tubes, one connecting end of each tube being connectable to corresponding openings provided on a closure of the container mounted in the dispensing appliance to bring them in fluid communication with the interior of the container.

20. The kit of parts according to claim 19, wherein the connecting ends of each of the dispensing tube and a gas tube are mounted in a lid of the dispensing appliance, the closing of which, upon the closure of the container mounted therein, drives them through the corresponding openings of the closure bringing the interior of the container in fluid communication with ambient and the chamber, respectively.

21. The kit of parts according to claim 20, wherein a valve is provided between the two ends of the dispensing tube.

22. The kit of parts according to the claim 21, wherein a valve is provided between the two ends of the gas tube.

* * * * *